United States Patent [19]

Harel et al.

[11] Patent Number: 4,908,943

[45] Date of Patent: Mar. 20, 1990

[54] METHOD OF FORMING LEAD TERMINALS ON ALUMINUM OR ALUMINUM ALLOY CABLES

[75] Inventors: Bernard Harel, St Cyr L'Ecole; Jacques Lefebvre, Voiron; Andre Savigny, Eaubonne, all of France

[73] Assignee: Precision Mecanique Labinal, Montigny Le Bretonneux, France

[21] Appl. No.: 177,700

[22] Filed: Apr. 5, 1988

[30] Foreign Application Priority Data

Apr. 6, 1987 [FR] France ..... 87 04818

[51] Int. Cl.[4] ..... H01R 11/08

[52] U.S. Cl. ..... 29/860; 29/879; 439/754; 439/887

[58] Field of Search ..... 29/857, 860, 874, 879; 439/754, 875, 887, 522

[56] References Cited

U.S. PATENT DOCUMENTS

| | | | |
|---|---|---|---|
| 1,548,552 | 8/1925 | Prax | 439/754 |
| 2,869,103 | 1/1959 | Wells . | |
| 4,039,244 | 8/1977 | Leachy | 439/887 |
| 4,413,408 | 11/1983 | Riggs, Jr. | 29/825 |
| 4,473,936 | 10/1984 | Kellner et al. | 29/825 X |
| 4,519,886 | 5/1985 | Oedenora et al. | 29/825 X |
| 4,526,666 | 7/1985 | Bianchi et al. | 29/825 X |

FOREIGN PATENT DOCUMENTS 2062273 6/1971 France .

*Primary Examiner*—Timothy V. Eley
*Attorney, Agent, or Firm*—Sandler & Greenblum

[57] ABSTRACT

To form lead or lead alloy terminals on cables comprising an insulative sheath and an aluminum core, the appropriate length of the core is bared and a metal part is fixed to the bared core. The terminal is then cast over this metal part. The metal part is compatible externally with the lead or the lead alloy forming the terminal and is compatible internally with the aluminum core. No high-resistivity substance is formed between any component layers of the resulting assembly.

34 Claims, 2 Drawing Sheets

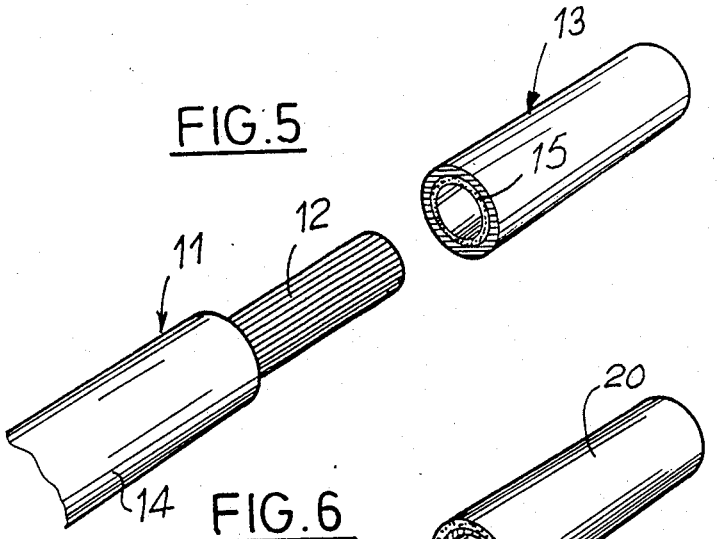
FIG.5
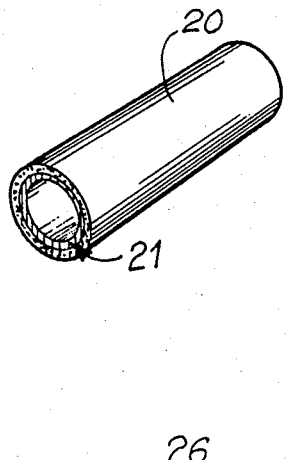
FIG.6
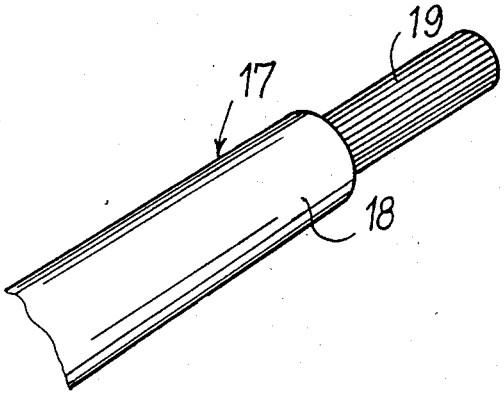
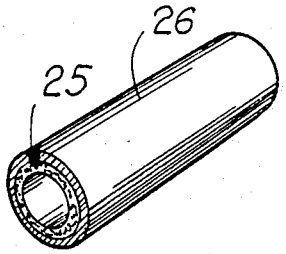
FIG.7
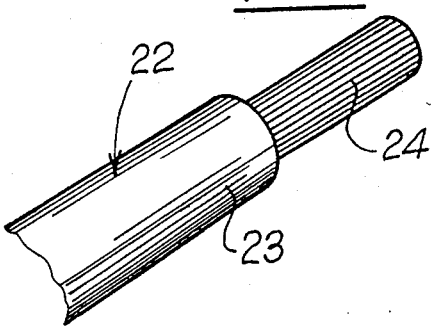

METHOD OF FORMING LEAD TERMINALS ON ALUMINUM OR ALUMINUM ALLOY CABLES

BACKGROUND OF THE INVENTION

1. Field of the invention

The present invention concerns a method of forming lead terminals or like objects on aluminum cables or cables made from an alloy with a high aluminum content.

The invention is more particularly directed to connecting terminals for accumulator batteries such as those fitted to automobile vehicles.

2. Description of the prior art

For economic reasons it is preferable to use aluminum rather than copper cables (lower cost price, reduced weight leading to energy savings in operation), but the aluminum-lead interface produces a substance on the cable which has a high electrical resistivity and opposes a good electrical contact.

An objective of the present invention is to provide a method which remedies the aforementioned disadvantage.

SUMMARY OF THE INVENTION

In one aspect, the invention consists in a method of forming lead or lead alloy terminals on cables comprising an insulative sheath and an alumimum core, in which method the appropriate length of the core is bared, a metal part is fixed to the bared core and the terminal is cast over said metal part and in which method said metal part is compatible externally with the lead or the lead alloy forming the terminal and is compatible internally with the aluminum core without any high-resistivity substance being formed.

An advantage of a method of this kind is that it does not alter in any significant way the usual techniques for casting lead onto cables.

In a first embodiment, the metal part is made from aluminum or aluminum alloy and has its external surface coated with a thin layer of nickel which is coated with a thin layer of lead.

In an alternative embodiment, the metal part is made from copper, copper alloy or brass and has its external surface coated with a thin layer of lead or lead-tin alloy.

In another alternative embodiment the metal part is made from aluminum or aluminum alloy and has its external surface coated with a thin layer of lead-tin alloy.

In a further alternative embodiment the metal part is made from aluminum or aluminum alloy and has its external surface plated with copper or bronze.

The terminal is preferably cast in such a way as to incorporate part of the end of said insulative sheath.

In another aspect, the invention consists in a battery terminal manufactured by a method as defined hereinabove.

The invention will now be described in more detail with reference to specific embodiments given by way of example only and shown in the appended drawings.

BRIEF DESCRIPTION OF THE DRAWINGS

FIGS. 5, 6 and 7 are views similar to FIG. 1 of alternative embodiments.

DESCRIPTION OF THE PREFERRED EMBODIMENTS

Figure 1:
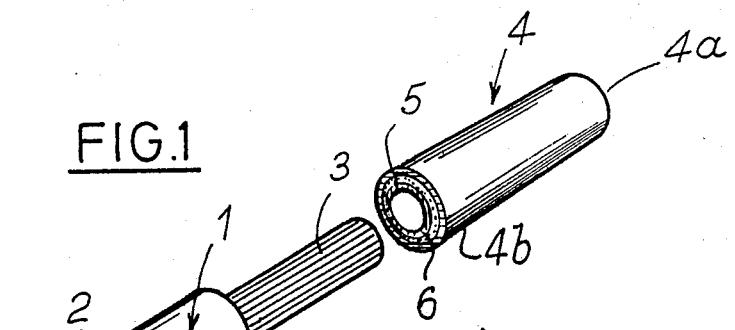
FIGS. 1 and 2 show separate stages of the method.
Figure 2:
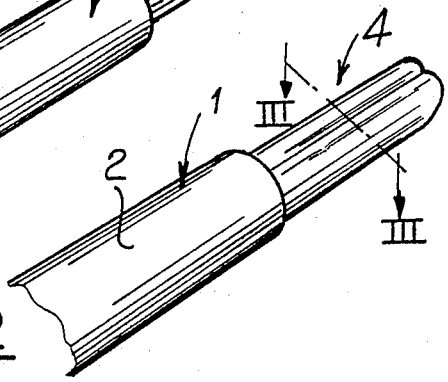
Figure 3:
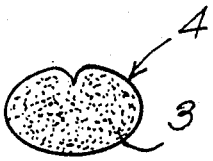
FIG. 3 is a view in cross-section on the line III—III in FIG. 2.

The reference numeral 1 designates a cable comprising an insulative sheath 2 and an aluminum core 3.

To perform the fixing the end of the cable 1 is stripped to lay bare a corresponding length of the core 3.

An aluminum part 4 is fitted over the length bared in this way, having its external surface coated with a very thin layer 5 of nickel (approximately 0.5 to 15) onto which a layer 6 of lead or lead-tin alloy is deposited electrochemically or by a dip method or in vacuo or by spraying/evaporation.

In the example shown the part 4 is in the form of a bush with a closed end **4*a* and a lateral skirt 4*b*, but it could equally well be a tubular part, a U-shape section part or otherwise. The part 4 is fixed onto the core 3 by punching, crimping, magnetoforming or compression drawing. In the example shown the sleeve 4 is fixed to the core 3** by crimping.

Figure 4:
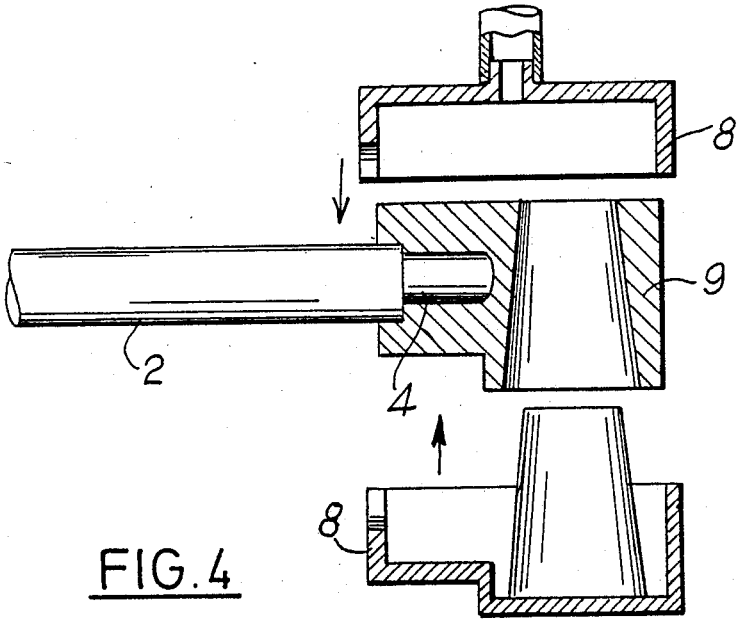
FIG. 4 shows the last phase of the method.

The end of the cable 1 with its sleeve 4 is placed into a two-part mold 8 in which the lead terminal 9 is cast directly. As seen in FIG. 4, the molding is performed in such a way that the end of the sheath 2 adjacent the bared part is incorporated in the terminal 9.

It will be understood that this embodiment is simple and reduces all the disadvantages of direct aluminum to lead fixings. The aluminum core 3 is bonded mechanically to the aluminum bush 4 and the thin layer 6 of lead provided on the bush provides a perfect interface with the terminal 9 which is cast on afterwards, without any high-resistivity substance being formed.

FIG. 5 shows an alternative embodiment in which the cable 11 comprises an aluminum core 2 and an insulative sheath 14.

The bared part of the cable is accommodated in a part 13 made from copper, copper alloy or brass the external surface of which is coated with a thin layer 15 of lead or lead-tin alloy.

The part 13 is fixed to the core in the usual way and the terminal is cast as shown in FIG. 4.

FIG. 6 shows an alternative embodiment in which the cable 17 comprises a sheath 18 and an aluminum core 19. The bared part is accommodated in a part 21 made from aluminum or aluminum alloy coated with a thin layer 20 of lead-tin alloy.

The part 21 may be fixed onto the core 19 in any way as specified in connection with the first embodiment, said part 21 then receiving the cast terminal as shown in and described with reference to FIG. 4.

Finally, FIG. 7 shows a final embodiment of the invention in which the part 25 is made from aluminum or aluminum alloy, its external surface being coated with a sub-layer 26 such as copper-plating or bronze-plating. The cable 22 comprises a sheath 23 and an aluminum core 24. As in the various previous embodiments, the part 25 is fixed to the core 24 and receives the cast terminal.

It is to be understood that the invention is not limited to the embodiments that have been described and shown. Numerous details thereof may be modified without departing from the scope of the invention.

There is claimed:

1. A method of forming terminals from a member selected from the group consisting of lead and lead alloy on cables having an insulative sheath and an aluminum core with a length of core being bared, comprising fixing a metal part to the length of bared core and casting the terminal over said metal part, said metal part being compatible externally with said lead or said lead alloy forming the terminal and being compatible internally with the aluminum core to avoid formation of high-resistivity substance.

2. The method according to claim 1, wherein said metal part is a member selected from the group consisting of aluminum and aluminum alloy, said metal part having an external surface coated with a thin layer of nickel which is coated with a thin layer of lead.

3. The method according to claim 1, comprising casting said terminal in such a way as to incorporate part of an end of said insulative sheath.

4. A battery terminal manufactured by a method comprising forming terminals from a member selected from the group consisting of lead and lead alloy on cables having an insulative sheath and an aluminum core with a length of core bared by fixing a metal part to the length bared core and casting the terminal over said metal part, wherein said metal part is compatible externally with said lead or said lead alloy forming the terminal and is compatible internally with the aluminum core to avoid forming high-resistivity substance being formed.

5. The battery terminal according to claim 4, wherein said metal part is a member selected from the group consisting of aluminum and aluminum alloy, said metal part having an external surface coated with a thin layer of nickel which is coated with a thin layer of lead.

6. The battery terminal according to claim 4, wherein said terminal is cast in such a way as to incorporate part of an end of said insulative sheath.

7. A method of manufacturing terminals from a member selected from the group consisting of lead and lead alloys on cables having an insulative sheath and an aluminum core with a length of core being bared, said method comprising:

(a) fixing a metal part having an external surface coated with a layer of material selected from the group consisting of lead, lead-tin alloys, copper and bronze, said metal part comprising a substance selected from the group consisting of copper, copper alloy, brass, aluminum, and aluminum alloy; and (b) casting a terminal part formed from a member selected from the group consisting of lead and lead alloy over said metal part, wherein said layer of material coated on said external surface of said metal part is compatible externally with said lead or said lead alloy forming the terminal and is compatible internally with said aluminum core so as to avoid forming high-resistivity substance.

8. The method according to claim 7, wherein said layer of material is selected from a group consisting of lead and lead-tin alloy and said substance is selected from the group consisting of copper, copper alloy and brass.

9. A method according to claim 7, wherein said layer of material is a lead-tin alloy and said substance is selected from the group consisting of aluminum and aluminum alloys.

10. A method according to claim 7, wherein said substance is selected from the group consisting of aluminum and aluminum alloy and said external surface is plated with a material selected from the group consisting of copper and bronze.

11. A battery terminal manufactured by a method of forming lead or lead alloy terminals on cables having an insulative sheath and an aluminum core wherein a length of the core is bared, comprising:

(a) a metal part having an external surface coated with a layer of material selected from the group consisting of lead, lead-tin alloys, copper and bronze, said metal part comprising a substance selected from the group consisting of copper, copper alloy, brass, aluminum and aluminum alloy, said metal part being fixed to a bared length of core, and said terminal comprising a member selected from the group consisting of lead and lead alloy being cast over said metal part, wherein said layer of material coated on said surface of said metal part is compatible externally with said lead or said lead alloy of the terminal and is compatible internally with said aluminum core thereby avoiding formation of high-resistivity substance.

12. The battery terminal in according to claim 11, wherein said layer of material is selected from the group consisting of lead and lead-tin alloy and said substance is selected from the group consisting of copper, copper alloy, and brass.

13. A battery terminal in accordance with claim 11, wherein said layer of material is lead-tin alloy and said substance is selected from the group consisting of aluminum and aluminum alloys.

14. A battery terminal according to claim 11, wherein said substance is selected from the group consisting of aluminum and aluminum alloy and said external surface is plated with a material selected from the group consisting of copper and bronze.

15. A method of forming a lead terminal on an aluminum cable comprising providing a connector between said lead terminal and said aluminum cable, said connector comprising a metal compatible with said lead terminal and said aluminum cable so as to avoid forming high-resistivity substances.

16. The method of forming a lead terminal according to claim 15, wherein said metal is selected from the group consisting of aluminum, aluminum alloys, copper, copper alloys and brass.

17. The method of forming a lead terminal according to claim 16, wherein said connector has an external surface with a coating of metal selected from the group consisting of a layer of nickel coated with a layer of lead, a layer of lead, a layer of lead-tin alloy, a layer of copper, and a layer of bronze.

18. The method of forming a lead terminal according to claim 17, wherein said metal is selected from the group consisting of aluminum and aluminum alloy and said coating of metal is selected from the group consisting of a layer of nickel coated with a layer of lead, a layer of lead-tin alloy, a layer of copper and a layer of bronze.

19. The method of forming a lead terminal according to claim 18, wherein said coating of metal is a layer of nickel coated with a layer of lead.

20. The method of forming a lead terminal according to claim 18, wherein said coating of metal is a layer of tin-lead alloy.

21. The method of forming a lead terminal according to claim 18, wherein said coating of metal is plated copper.

22. The method of forming a lead terminal according to claim 18, wherein said coating of metal is plated bronze.

23. The method of forming a lead terminal according to claim 17, wherein said metal is selected from the group consisting of copper, copper alloy, and bronze.

24. The method of forming a lead terminal according to claim 23, wherein said coating of metal is selected from the group consisting of lead and lead-tin alloy.

25. A terminal comprising:

(a) a terminal portion comprising a member selected from the group consisting of lead and lead alloy;

(b) a cable having a core comprising a member selected from the group consisting of aluminum and aluminum alloy connected to said terminal portion; and (c) a connector interconnecting said cable with said terminal portion, said connector comprising a metal compatible with said lead terminal and said aluminum cable so as to avoid forming high-resistivity substances.

26. The terminal as defined by claim 25, wherein said metal is selected from the group consisting of aluminum, aluminum alloys, copper, copper alloys and brass.

27. The terminal as defined by claim 26, wherein said connector has an external surface with a coating of metal selected from the group consisting of a layer of nickel coated with a layer of lead, a layer of lead, a layer of lead-tin alloy, a layer of copper, and a layer of bronze.

28. The terminal as defined by claim 27, wherein said metal is a member selected from the group consisting of aluminum and aluminum alloy and said coating of metal is selected from the group consisting of a layer of nickel coated with a layer of lead, a layer of lead-tin alloy, a layer of copper, and a layer of bronze.

29. The terminal as defined by claim 28, wherein said coating of metal is a layer of nickel coated with a layer of lead.

30. The terminal as defined by 28, wherein said coating of metal is a layer of tin-lead alloy.

31. The terminal as defined by claim 28, wherein said coating of metal is plated copper.

32. The terminal as defined by claim 28, wherein said coating of metal is plated bronze.

33. The terminal as defined by claim 27, wherein said metal is a member selected from the group consisting of copper, copper alloy, and bronze.

34. The terminal as defined by claim 33, wherein said coating of metal is selected from the group consisting of lead and lead-tin alloy.

* * * * *

UNITED STATES PATENT AND TRADEMARK OFFICE

CERTIFICATE OF CORRECTION

PATENT NO. : 4,908,943

DATED : March 20, 1990

INVENTOR(S) : B. HAREL et al.

It is certified that error appears in the above-identified patent and that said Letters Patent is hereby corrected as shown below:

On the title page:

At the left column of the front page, at [54], insert ——OR LIKE OBJECTS—— after "TERMINALS";

At column 1, line 1, insert ——OR LIKE OBJECTS—— after "TERMINALS";

At the left column of the front page, at [73], the second Assignee, ——Aluminum Pechiney, Paris, France—— should be added after "Precision Mecanique Labinal, Montigny Le Bretonneux, France".

At column 2, line 37, change "2" to --12--.

Signed and Sealed this

Eighth Day of October, 1991

*Attest:*

HARRY F. MANBECK, JR.

*Attesting Officer*

*Commissioner of Patents and Trademarks*